US006715440B2

(12) United States Patent
Biedenweg et al.

(10) Patent No.: US 6,715,440 B2
(45) Date of Patent: Apr. 6, 2004

(54) CHANGING ROOM FOR PONTOON BOATS HAVING A REAR ENTRY STERN GATE

(75) Inventors: Baron R. Biedenweg, Fort Wayne, IN (US); David L. Putman, Rome City, IN (US)

(73) Assignee: Harris Kayot, Inc., Fort Wayne, IN (US)

( * ) Notice: Subject to any disclaimer, the term of this patent is extended or adjusted under 35 U.S.C. 154(b) by 0 days.

(21) Appl. No.: 10/200,345

(22) Filed: Jul. 22, 2002

(65) Prior Publication Data

US 2004/0011272 A1 Jan. 22, 2004

(51) Int. Cl.[7] ..... B63B 17/00
(52) U.S. Cl. ..... 114/363; 114/343; 114/364
(58) Field of Search ..... 114/363, 364, 114/343; 160/333; 297/184.14; 4/460, 597, 449

(56) References Cited

U.S. PATENT DOCUMENTS 5,331,917 A * 7/1994 Magers ..... 114/361
6,302,053 B1 * 10/2001 Tomczak et al. ..... 114/363

OTHER PUBLICATIONS

Brochure—2002 Pontoon Series—Bennington Marine.
Brochure—Princecraft Pontoon and Deck Boats 2002 Edition.
Brochure—Sylvan 2002 Pontoon & Fiberglass.
Brochure—2002 Premier Pontoons.
Brochure—1994 Kayot Deck Style Boats/Pontoons.
Brochure—Princecraft Pontoons & Deck Boats.
Brochure—1996 Crest Pontoon Boats.
Brochure—1996 Crest Fishing Boats.
Brochure—1995 Crest Pontoon Boats.

* cited by examiner

*Primary Examiner*—Ed Swinehart
(74) *Attorney, Agent, or Firm*—Baker & Daniels

(57) ABSTRACT

A collapsible changing room for a pontoon boat having a rear entry stern gate. The collapsible changing room is formed in part by the passenger seat positioned adjacent the rear entry stem gate. An L-shaped bracket is rigidly secured to the rear portion of the seat and is further hingedly secured to a vertical fence member spaced from the seat back. The seat and the L-shaped support can be rotated upwardly away from the boat deck to a position in which the seat bottom is generally perpendicular to the boat deck. When the seat is rotated to this position, a curtain frame hingedly connected to the seat can be rotated from a stored position within the seat base to an extended position substantially parallel to the boat deck. An opaque sheet or curtain depends from the curtain frame in a substantially vertical orientation to form an enclosed changing or privacy room. Generally, the curtain will include an opening having a closing mechanism such as a zipper to allow entry into the region partitioned by the curtain.

53 Claims, 6 Drawing Sheets

CHANGING ROOM FOR PONTOON BOATS HAVING A REAR ENTRY STERN GATE

BACKGROUND OF THE INVENTION

1. Field of the Invention

The present invention relates to a changing room for a boat, and, more particularly, to a collapsible changing room adapted for placement at the stem or rear of a pontoon boat having a rear entry stem gate, without decreasing available seating in the boat, while allowing for a rear entry configuration.

2. Description of the Related Art

Pontoon boats are typically constructed with a deck positioned atop at least two pontoons and with seating surfaces and boat controls positioned inside a fenced area atop the deck. Generally, an outboard motor is connected to the stem of a pontoon boat and provides the means for propelling the boat through the water. Pontoon boats typically do not include enclosed cabins, however, pontoon boat operators and passengers many times find it convenient to have access to an area of privacy on the pontoon boat, e.g., for changing clothes or use of a portable toilet. With this in mind, boat manufacturers have sought to provide an area of privacy, or changing room for use in conjunction with a pontoon boat.

Because changing rooms are generally infrequently utilized on pontoon boats, boat manufacturers generally utilize collapsible changing rooms which may be stowed out of the way when not in use. While described with reference to a pontoon boat, the collapsible changing room of the present invention is adaptible to various watercraft and other moveable platforms.

FIGS. 3 and 4 illustrate prior art rotatable passenger seat 34*a*'. As illustrated, rotatable passenger seat 34*a*' rotates about pivot point 58' between the positions illustrated in FIGS. 3 and 4. To achieve the position illustrated in FIG. 4, lounge cushion 42' must shift downwardly toward deck 24'. This downward shifting of lounge cushion 42' prevents rotatable passenger seat 34*a*' from being positioned in line with motor 32 (FIG. 1), as motor 32 will prevent this downward shifting of lounge cushion 42'. While not illustrated in FIGS. 3 and 4, boats typically include a rail extending from the rearward portion of lounge cushion 42' which exacerbates the problem of interference from motor 32.

In pontoon boat construction, it is advantageous to provide a number of gates allowing entry and exit from the fenced area of the pontoon boat. Generally, a pontoon boat includes an L-shaped seating surface having a stem leg as well as a leg positioned opposite the captain's chair and console. Such an L-shaped seating surface is depicted in FIG. 1. If a rear entry stem gate is desired, the stem portion of the L-shaped seating surface terminates just prior to the rear entry stem gate as illustrated in FIG. 1.

When designing a pontoon boat, it is generally desirable to position a collapsible changing room toward the rear of the boat to provide maximum privacy for the individual utilizing the room and to minimize the negative impact on available seating. In the prior art, this generally meant that the stem fence gate was eliminated to accommodate a collapsible changing room.

What is needed in the art is a collapsible changing room for use with a pontoon boat which does not necessitate elimination of the rear entry stem gate and does not reduce available seating.

SUMMARY OF THE INVENTION

The present invention provides a collapsible changing room formed in part by the passenger seat positioned adjacent the rear entry stem gate. To allow for this positioning of the collapsible changing room, an L-shaped bracket is rigidly secured to the rear portion of the seat and is further hingedly secured to a vertical fence member. The seat and L-shaped bracket can be rotated upwardly away from the boat deck to a position in which the seat bottom is generally perpendicular to the deck, without requiring displacement of the rear lounge cushion and/or protective rail secured adjacent the lounge cushion. When the seat is rotated to this position, a curtain frame hingedly connected to the seat can be rotated from a stored position within the seat base to an extended position substantially parallel to the boat deck. An opaque sheet or curtain depends from the curtain frame in a substantially vertical orientation to form an enclosed changing or privacy room. Generally, the curtain will include an opening having a closing mechanism such as a zipper to allow entry into the region partitioned by the curtain.

A biasing member, such as a gas strut may be utilized to maintain the seat in its upwardly rotated position. Similarly, a biasing member such as a gas strut may be utilized to retain the curtain rod in its extended position substantially parallel to the boat deck.

An advantage of the present invention is the ability to provide a pontoon boat having a rear entry stem gate with a collapsible changing room without losing available seating.

Another advantage of the present invention is the ability to position a collapsible changing room in line with the outboard or stem drive motor of a pontoon boat without fear that a portion of the collapsible changing room, e.g., a lounge cushion or outer rail will contact the outboard motor when the changing room is deployed.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Figure 1:
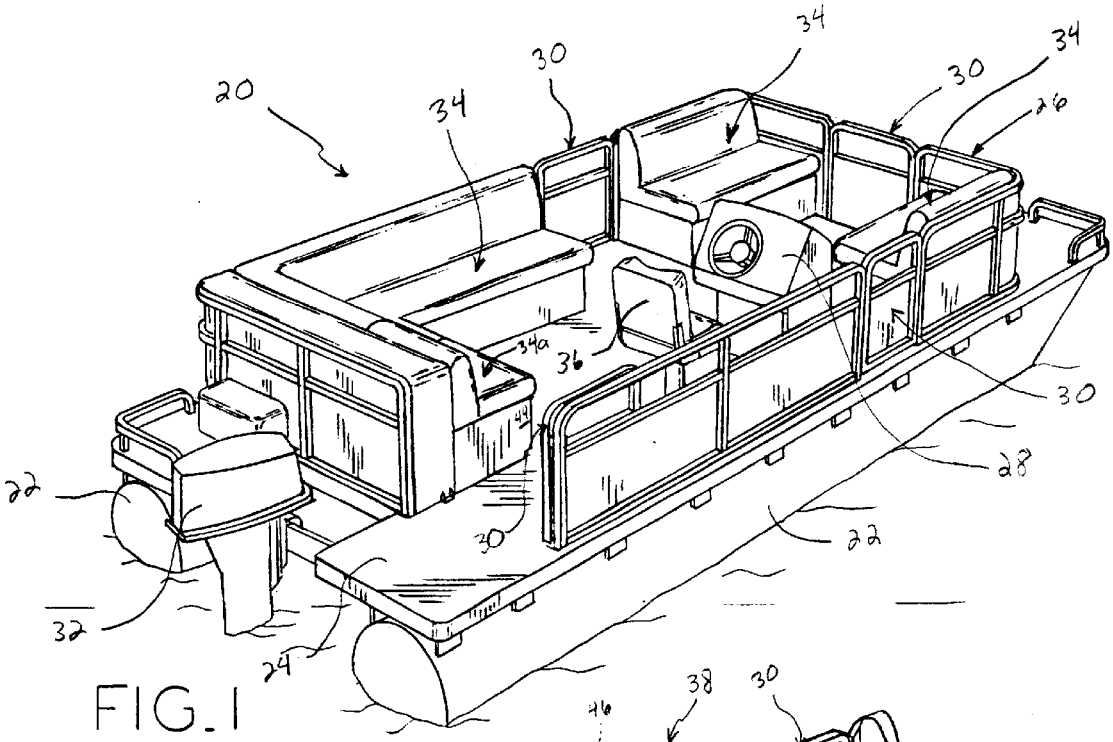
FIG. 1 is a perspective view of a pontoon boat incorporating a collapsible changing room in accordance with the present invention.

Corresponding reference characters indicate corresponding parts throughout the several views. Although the drawings represent embodiments of the present invention, the drawings are not necessarily to scale and certain features may be exaggerated to better illustrate and explain the present invention. The exemplifications set out herein illustrate embodiments of the invention, and such exemplifications are not to be construed as limiting the scope of the invention in any manner.

DETAILED DESCRIPTION OF THE INVENTION

Referring now to the drawings and particularly to FIG. 1, there is illustrated pontoon boat 20 including pontoons 22, deck 24, and fence 26. As illustrated, fence 26 generally surrounds the perimeter of boat 20 and encloses the seating area of boat 10. As illustrated, captain's chair 36, console 28, and passenger seats 34 are positioned in the seating area defined by fence 26. As illustrated in FIG. 1, fence 26 incorporates a plurality of gates 30 allowing access to the seating area. Motor 32 is utilized to propel boat 20.

Figure 2:
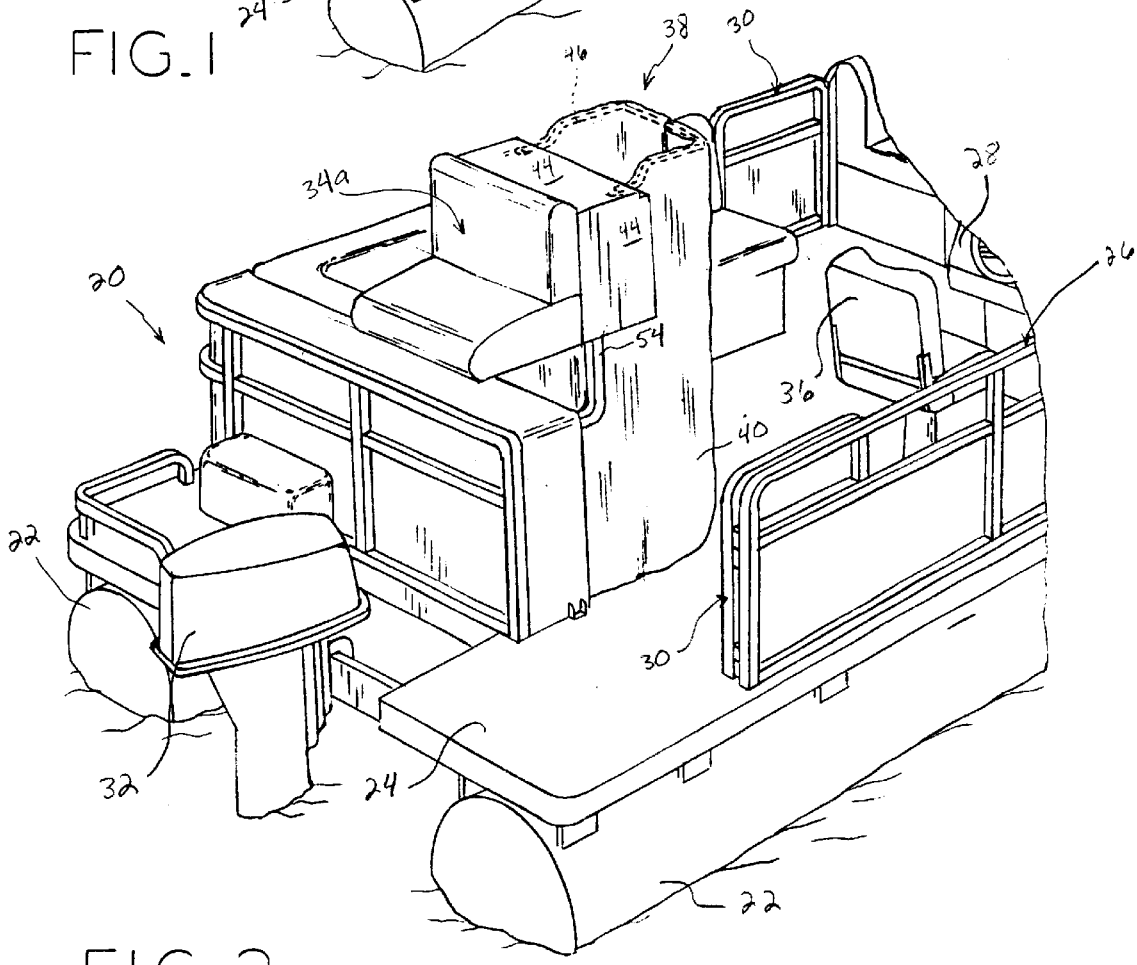
FIG. 2 is a partial perspective view of the pontoon boat of FIG. 1 illustrating the collapsible changing room in its deployed position.
Figure 3:
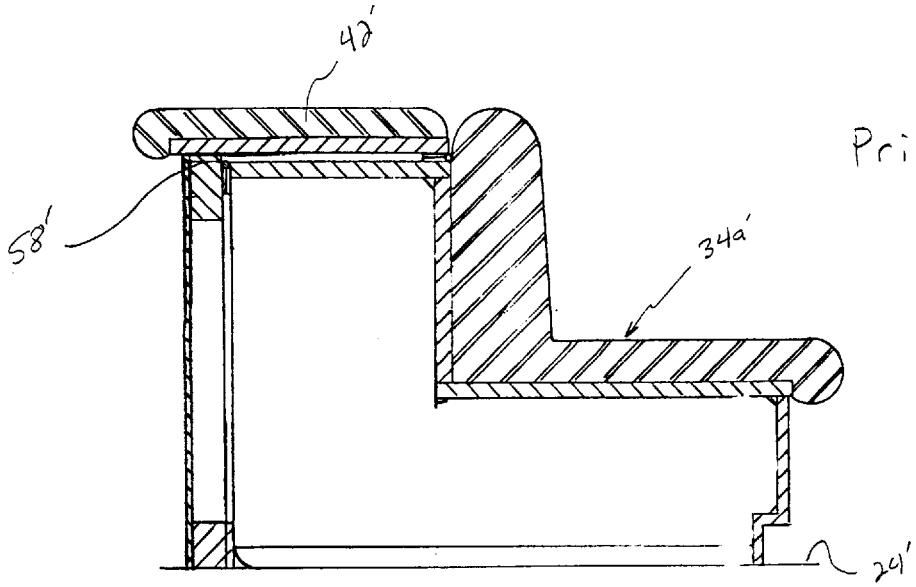
Prior Art FIG 3
FIG. 3 is sectional view of a prior art rotatable seat utilized to form a portion of a collapsible changing room.
Figure 4:
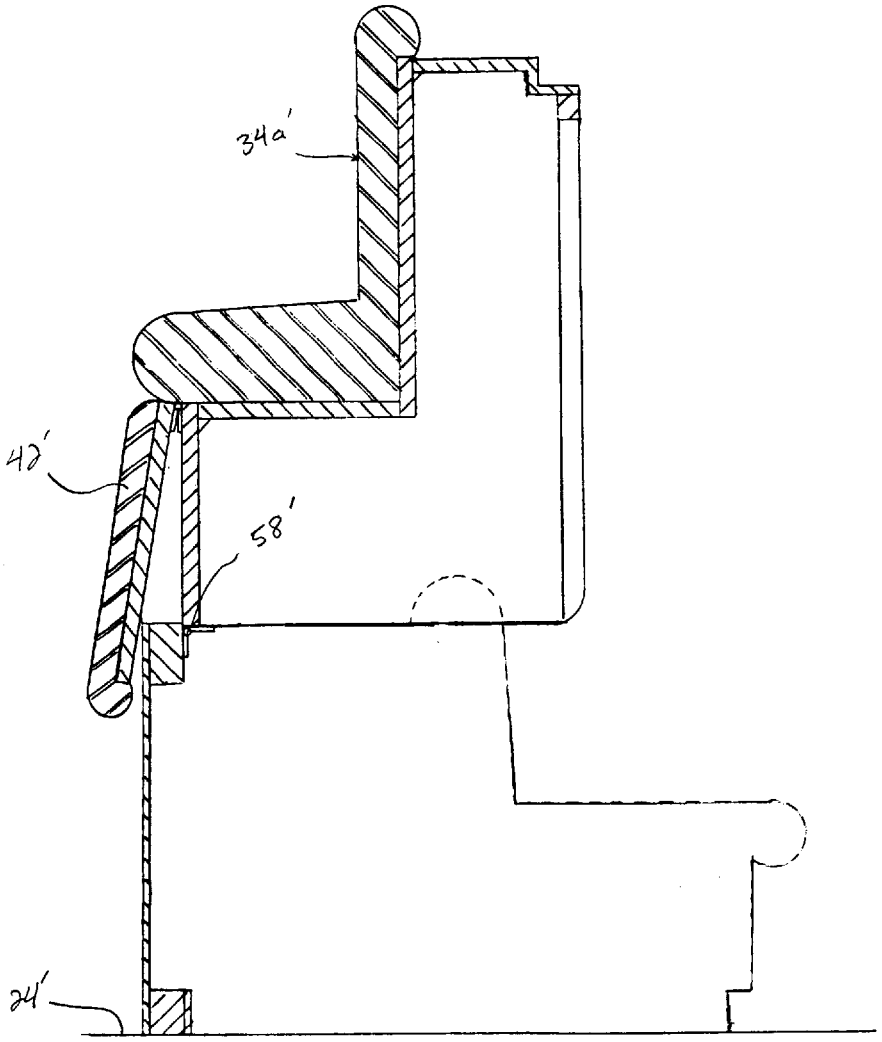
Prior Art FIG. 4
FIG. 4 is a sectional view illustrating rotation of the rotatable seat of FIG. 3 into a position from which a collapsible changing room may be deployed.
Figure 5:
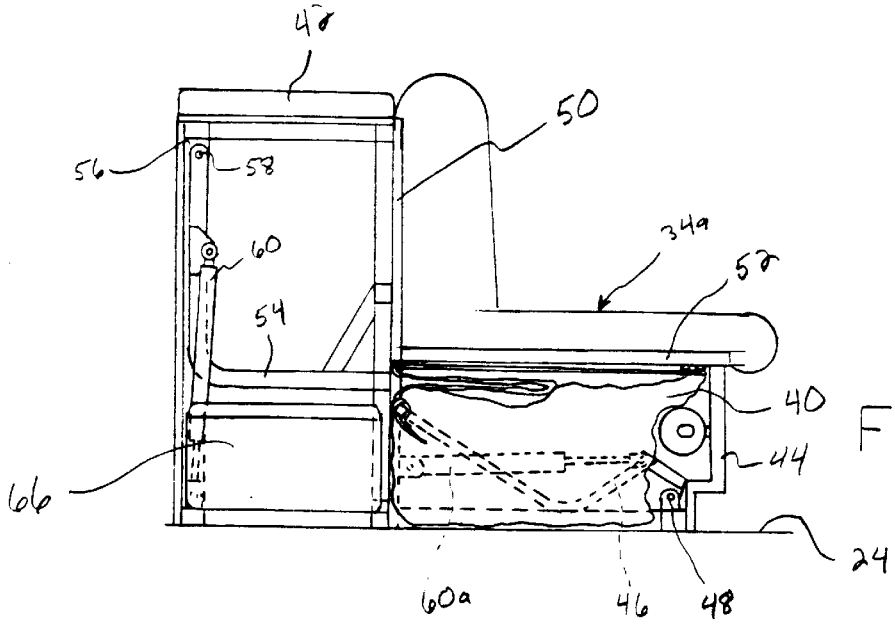
FIG. 5 is a sectional view of a collapsible changing room in accordance with the present invention.
Figure 6:
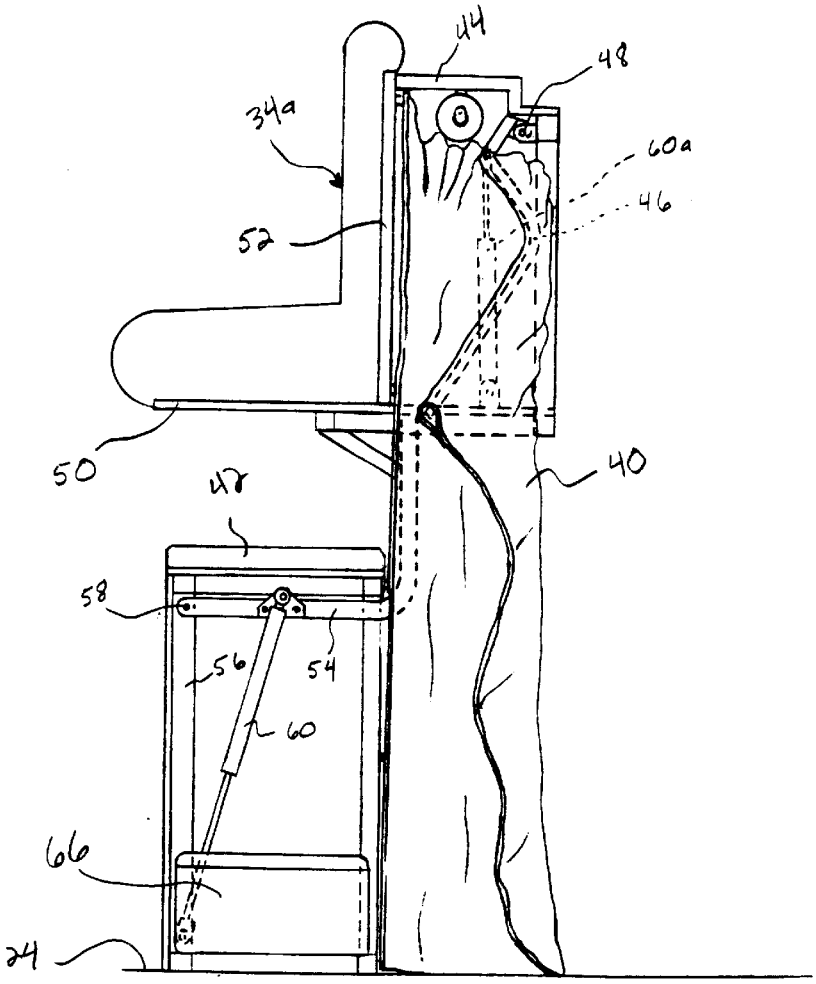
FIG. 6 is a sectional view of a collapsible changing room of the present invention illustrating rotation of the rotatable seat to allow for deployment of the collapsible changing room.
Figure 9:
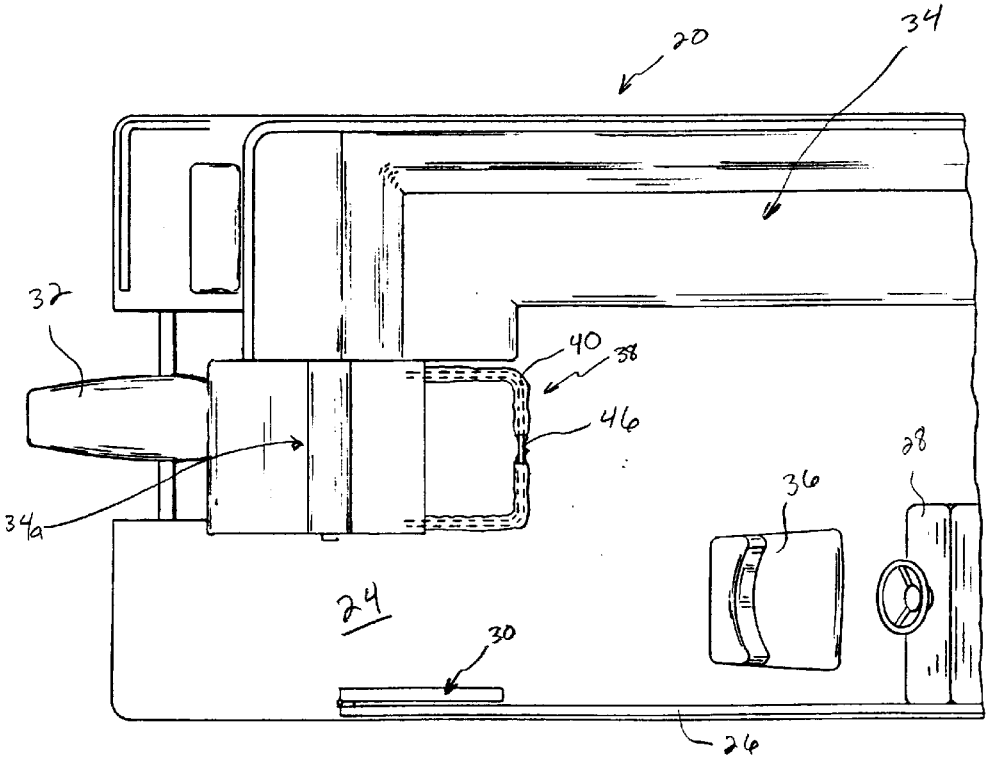
FIG. 9 is a partial top plan view thereof illustrating a deployed collapsible changing room as the present invention.

Referring to FIG. 2, collapsible changing room 38 may be deployed to provide an area of privacy on pontoon boat 20 to allow for, e.g., changing of clothes. As illustrated in FIG. 2, L-shaped bracket 54 is secured to rotatable passenger seat 34*a*. Referring to FIG. 5, L-shaped bracket 54 extends rearwardly from seat back 50 and is rotatably connected to vertical fence member 56 at an opposite end thereof. To allow for connection of L-shaped bracket 54 to vertical fence member 56, L-shaped bracket 54 extends rearwardly from seat back 50 (FIG. 6) to allow for connection thereof to vertical fence member 56 which is spaced a distance behind seat back 50. As illustrated in FIGS. 5 and 6, rotatable passenger seat 34*a* rotates about pivot point 58 to allow for displacement of rotatable passenger seat 34*a* from the position illustrated in FIG. 5 allowing its use as a seat to the position illustrated in FIG. 6 allowing deployment of collapsible changing room 38 as illustrated in FIGS. 2, 7, and 9.

FIGS. 1, 5, 8, 10 and 11 illustrate rotatable passenger seat 34*a* in a seating position. For the purposes of this document, "seating position" means a position in which rotatable passenger seat 34*a* is oriented to receive a user in a sitting posture. To deploy collapsible changing room 38 as illustrated in FIGS. 2, 7, and 9, rotatable passenger seat 34*a* is rotated about pivot point 58 to a rotated position as illustrated in FIGS. 2, 6, 7, and 9. When rotatable passenger seat 34*a* achieves the rotated position, curtain frame 46 can be moved from its stored position beneath seat support 52 as illustrated in FIGS. 5, 6, 10, and 11 to its extended position as illustration in FIGS. 2, 7, and 9. In the exemplary embodiment illustrated herein, curtain frame 46 is moved from its stored position to its extended position by rotating curtain frame 46 about pivot point 48. While illustrated as a solid hinged member, it is contemplated that curtain frame 46 may be formed as a collapsible member such as, e.g., a telescoping member extendable from a stored position into a use position.

Figure 7:
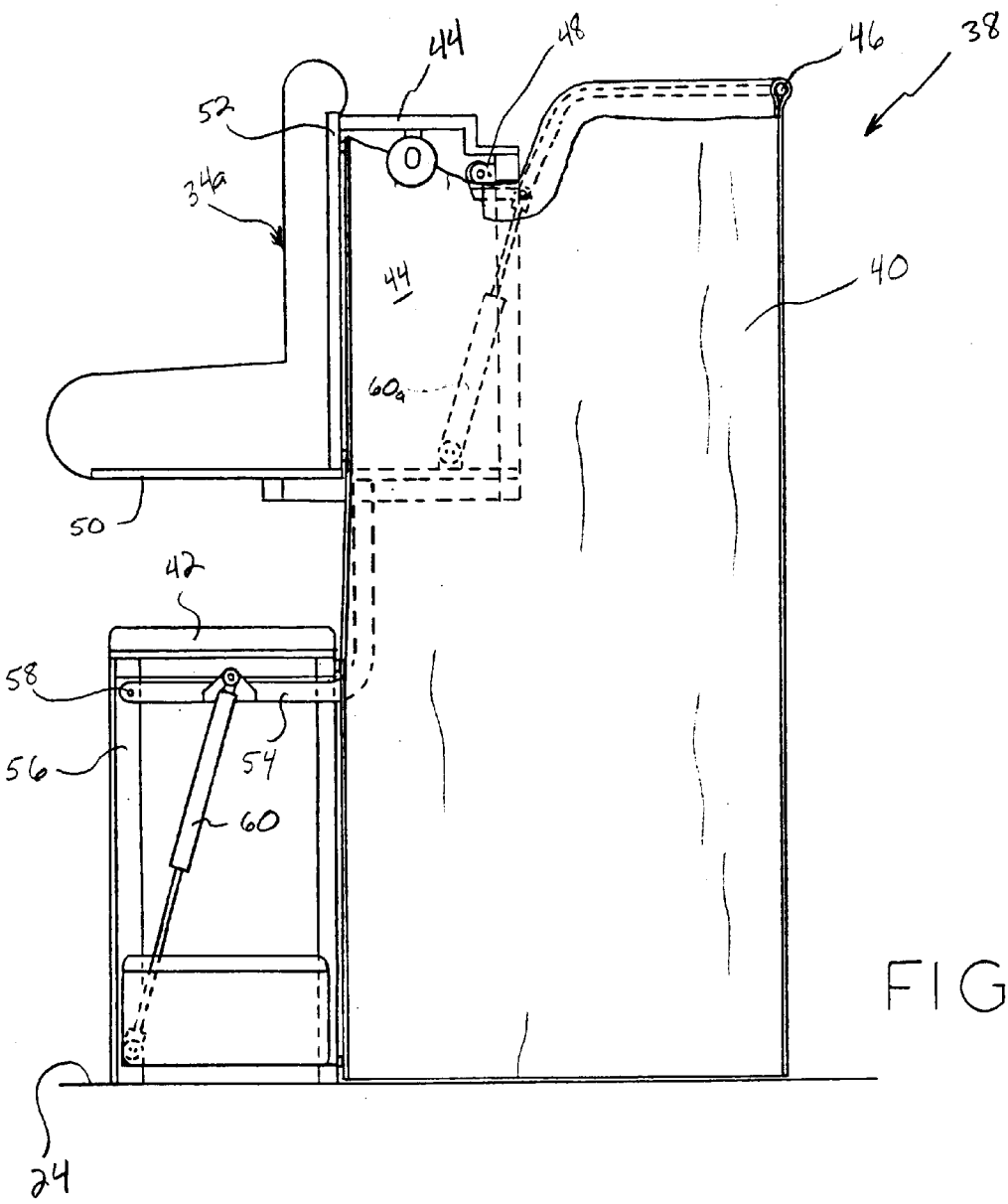
FIG. 7 is a partial sectional view illustrating deployment of a changing room in accordance with the present invention.
Figure 8:
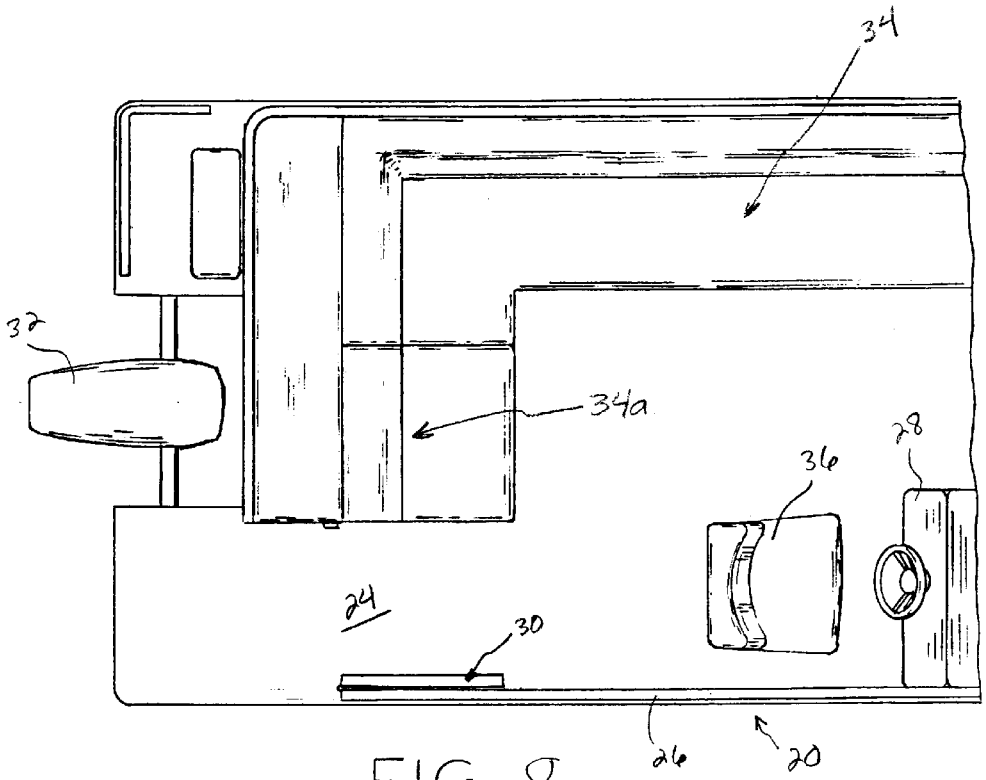
FIG. 8 is a partial top plan view of a pontoon boat including a changing room in accordance with the present invention.

As illustrated in FIGS. 5–7, 10, and 11, gas struts 60 are rotatably connected to L-shaped brackets 54 and vertical fence member 56. Gas struts 60 are useful to maintain rotatable passenger seat 34*a* in the rotated position illustrated in FIG. 6 to allow deployment of collapsible changing room 38. Similarly, gas struts 60*a* are rotatably connected to curtain frame 46 and seat back 50, and are useful to maintain deployment of curtain frame 46 as illustrated in FIG. 7. As illustrated in FIG. 7, curtain 40 is secured to a bottom surface of seat support 52 and further encloses and hangs from curtain frame 46 to create an enclosed changing room.

As illustrated in FIGS. 5–7, movement of rotatable passenger seat 34*a* from the seating position illustrated in FIG. 5 to the rotated position illustrated in FIGS. 6 and 7 does not require displacement of lounge cushion 42 which extends rearwardly from seat back 50 as illustrated in FIG. 5. While not depicted in FIGS. 5–7, lounge cushion 42 typically extends rearwardly from vertical fence member 56. Furthermore, typical pontoon boats include a rail extending further rearwardly from lounge cushion 42. In any event, the collapsible changing room of the present invention does not require displacement of lounge cushion 42 and any structure associated therewith. With this in mind, the collapsible changing room of the present invention may be positioned over motor 32 (FIGS. 1 and 2) without worry that motor 32 will interfere with deployment of collapsible changing room 38. With this in mind, collapsible changing room 38 of the present invention may advantageously be utilized in a pontoon boat having a rear entry stern gate without decreasing available seating.

Figure 10:
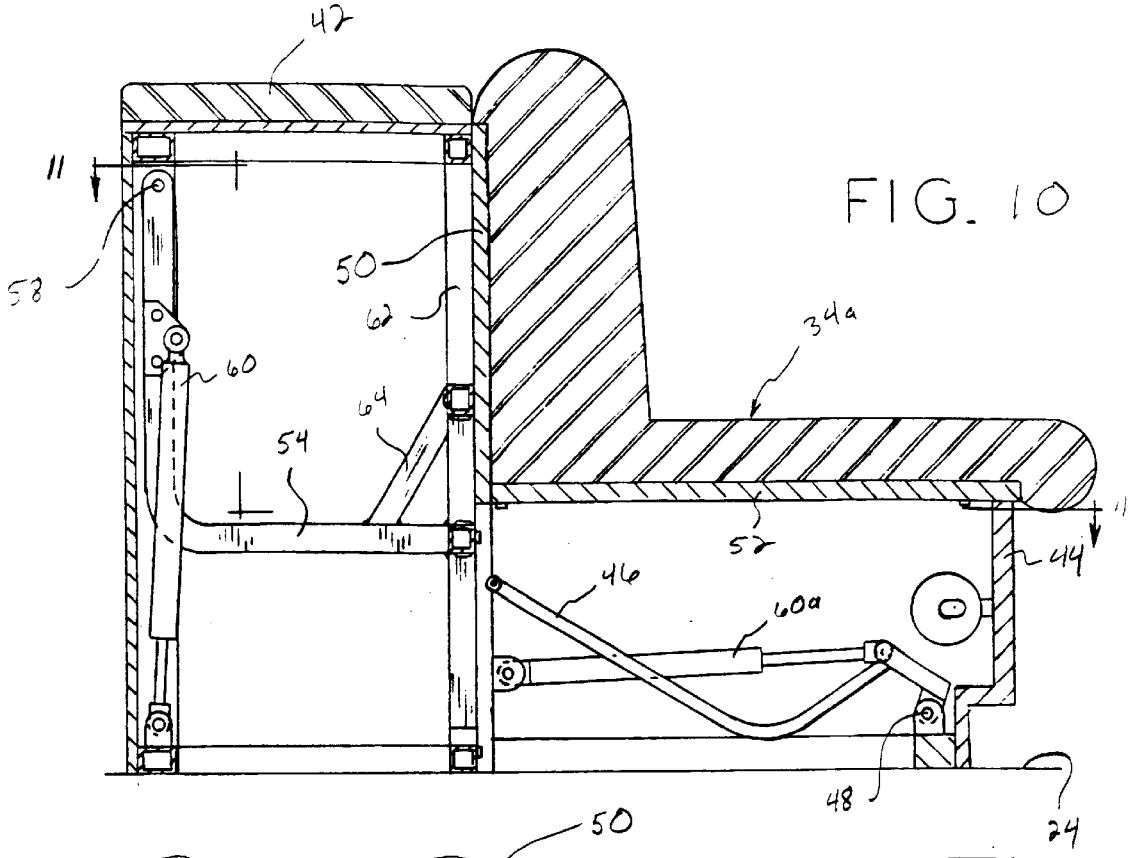
FIG. 10 is a sectional view of a collapsible changing room in accordance with the present invention.
Figure 11:
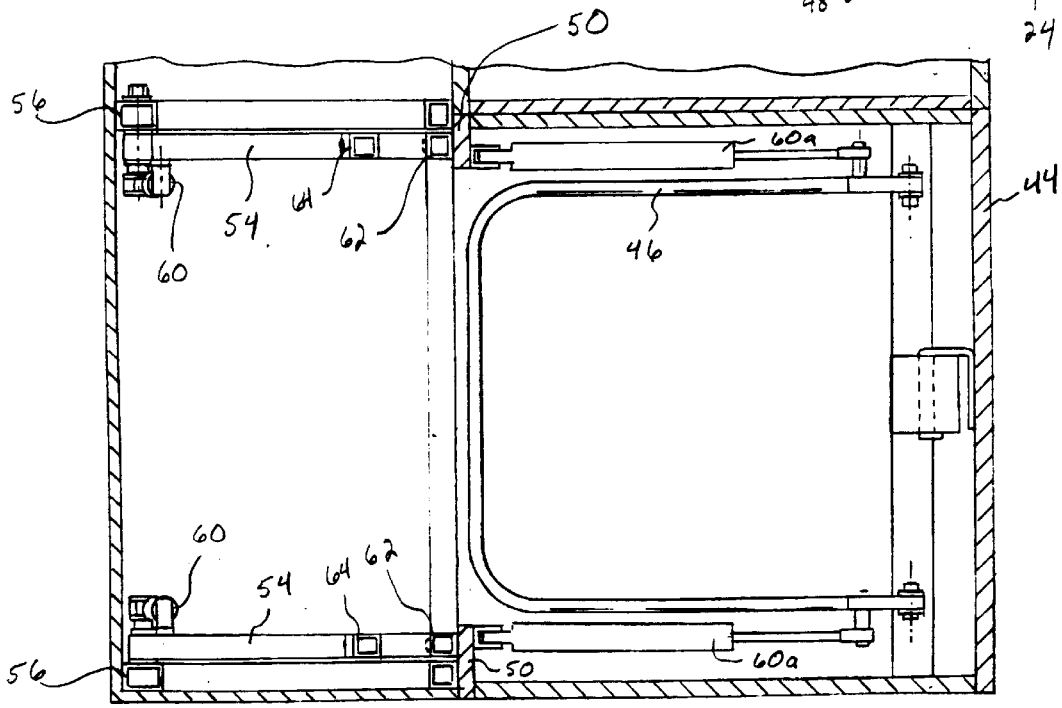
FIG. 11 is a sectional view taken along line 11—11 of FIG. 10.

As illustrated in FIG. 10, the structure of collapsible changing room 38 is hidden in use by passenger seat base walls 44. Furthermore, as illustrated in FIGS. 5 and 6, portable toilet 66 may be stowed beneath lounge cushion 42 for use when collapsible changing room 38 is deployed. Referring to FIGS. 10 and 11, a pair of L-shaped brackets 54 are utilized with the exemplary embodiment illustrated herein. As illustrated in FIG. 10, L-shaped brackets 54 are connected to rotatable passenger seat 34*a* via vertical frame member 62. L-shaped brackets 54 are connected to rotatable passenger seat 34*a* adjacent the intersection of seat back 50 and seat support 52. Various frame members may be utilized to assure a rigid connection of L-shaped brackets 54 to rotatable passenger seat 34*a*, including support frame members 64 illustrated in FIG. 10. As illustrated in FIG. 6, curtain 40 is secured to rotatable passenger seat 34*a* such that when collapsible changing room 38 is deployed, curtain 40 partitions an area of privacy, or changing room.

While this invention has been described as having a preferred design, the present invention can be further modified within the spirit and scope of this disclosure. This application is therefore intended to cover any variations, uses, or adaptations of the invention using its general principles. Further, this application is intended to cover such departures from their present disclosure as come within known or customary practice in the art to which this invention pertains and which fall within the limits of the appended claims.

What is claimed is:

1. A collapsible changing room, comprising:

a rotatable seat, comprising:

a seat support;

a seat back connected to said seat support;

an L-shaped bracket having a first leg and a second leg, said first leg having a first end fixed to said rotatable seat, said second leg extending from said first leg substantially parallel to said seat back, said second leg spaced from said seat back, said second leg having a hinge end opposite the intersection of said first and said second legs;

a curtain frame rotatably connected to said rotatable seat, said curtain frame rotatable from a stored position adjacent said seat support to an extended position extending from and substantially perpendicular to said seat; and a flexible curtain depending from said curtain frame;

said rotatable seat rotatable about said hinge end of said second leg of said L-shaped bracket from a seating position to a rotated position, said curtain frame and said curtain stowable under said seat support in said stored position when said rotatable seat maintains said seating position, said curtain frame rotatable to said extended position when said rotatable seat achieves said rotated position, said curtain forming a changing room when said rotatable seat achieves said rotated position and said curtain frame achieves said extended position.

2. The collapsible changing room of claim 1, further comprising:

a seat cushion positioned atop said seat support; and a seat back cushion positioned atop a first side of said seat back.

3. The collapsible changing room of claim 1, further comprising:

a first biasing member connected to said L-shaped bracket, said biasing member operable to maintain said rotatable seat in said rotated position; and a second biasing member connected to said curtain frame, said biasing member operable to maintain said curtain frame in said second position.

4. The collapsible changing room of claim 3, wherein said first and said second biasing members comprise gas shocks.

5. The collapsible changing room of claim 1, wherein said curtain frame is substantially U-shaped, said curtain frame having a pair of opposing sides and an end perpendicular to and spanning said sides, said end substantially parallel to and spaced from said seat when said curtain frame achieves said extended position.

6. A collapsible changing room, comprising:

a rotatable seat, comprising:

a seat support;

a seat back connected to said seat support;

bracket means for rotatably connecting said rotatable seat to a structure positioned a distance from said rotatable seat, said bracket means including a hinge end defining a pivot point for said rotatable seat, said hinge end rotatably connected to said structure, said bracket means further including an attachment end fixed to said rotatable seat;

curtain frame means for supporting a flexible curtain, said curtain frame means connected to said rotatable seat; and a flexible curtain depending from said curtain frame means;

said rotatable seat rotatable about said pivot point from a seating position to a rotated position, said curtain frame means and said curtain stowable under said seat when said rotatable seat maintains said seating position, said curtain frame means extendable substantially perpendicularly from said seat support when said rotatable seat achieves said rotated position, said curtain forming a changing room when said rotatable seat achieves said rotated position and said curtain frame means is extended from said rotatable seat.

7. The collapsible changing room of claim 6, wherein said bracket means comprises an L-shaped bracket having a first leg and a second leg, said first leg including said attachment end, said second leg extending from said first leg substantially parallel to said seat back, said second leg spaced from said seat back and including said hinge end.

8. The collapsible changing room of claim 6, wherein said curtain frame means comprises a curtain frame rotatably connected to said rotatable seat, said curtain frame rotatable from a stored position adjacent said seat support to an extended position extending from and substantially perpendicular to said seat support.

9. The collapsible changing room of claim 6, further comprising:

a seat cushion positioned atop said seat support; and a seat back cushion positioned atop a first side of said seat back.

10. The collapsible changing room of claim 8, further comprising:

a first biasing member connected to said bracket means, said biasing member operable to maintain said rotatable seat in said rotated position; and a second biasing member connected to said curtain frame, said biasing member operable to maintain said curtain frame in said extended position.

11. The collapsible changing room of claim 10, wherein said first and said second biasing members comprise gas shocks.

12. The collapsible changing room of claim 8, wherein said curtain frame is substantially U-shaped, said curtain frame having a pair of opposing sides and an end perpendicular to and spanning said sides, said ends substantially parallel to and spaced from said seat when said curtain frame is extended from said seat.

13. A boat and changing room combination, comprising:

a boat, comprising:

a pair of pontoons;

a deck secured to said pontoons;

a fence secured to said deck, said fence enclosing a seating area, said fence including a rear entry stern gate allowing entry into said seating area;

a rotatable seat positioned adjacent said rear entry stern gate, said rotatable seat spaced from said fence, said rotatable seat comprising:

a seat support;

a seat back connected to said seat support;

an L-shaped bracket having a first leg and a second leg, said first leg fixed to said rotatable seat, said second leg extending from said first leg, said second leg hingedly secured to said fence;

a curtain frame rotatably connected to said rotatable seat, said curtain frame rotatable from a stored position adjacent said seat to an extended position extending from and substantially perpendicular to said seat; and a flexible curtain depending from said curtain frame;

said rotatable seat rotatable about said fence from a seating position to a rotated position, said curtain frame and said curtain stowable under said seat in said stored position when said rotatable seat maintains said seating position, said curtain frame rotatable to said extended position when said rotatable seat achieves said rotated position, said curtain forming a changing room when said rotatable seat achieves said rotated position and said curtain frame achieves said extended position.

14. The combination of claim 13, wherein said first leg of said L-shaped bracket has a first end fixed to said rotatable seat adjacent an intersection of said seat back and said seat, said second leg extending from said first leg substantially parallel to said seat back, said second leg spaced from said seat back.

15. The combination of claim 13, further comprising:

a seat cushion positioned atop said seat support; and a seat back cushion positioned atop a first side of said seat back.

16. The combination of claim 13, further comprising:

a first biasing member connected to said L-shaped bracket, said biasing member operable to maintain said rotatable seat in said rotated position; and a second biasing member connected to said curtain frame, said biasing member operable to maintain said curtain frame in said extended position.

17. The combination of claim 16, wherein said first and said second biasing members comprise gas shocks.

18. The combination of claim 13, wherein said curtain frame is substantially U-shaped, said curtain frame having a pair of opposing sides and an end perpendicular to and spanning said sides, said end substantially parallel to and spaced from said seat support when said curtain frame achieves said second position.

19. A boat, comprising:

a deck;

a rotatable seat, comprising:

a seat support;

a seat back connected to said seat support;

a lounge cushion positioned atop said deck adjacent said seat back and extending in a rearward direction away from said seat back;

said rotatable seat rotatable between a seating position and a rotated position without movement of said lounge cushion;

a curtain frame connected to said rotatable seat; and a curtain depending from said curtain frame;

said curtain frame and said curtain stowable under said seat when said rotatable seat maintains said seating position, said curtain frame extendable from said seat support to an extended position when said rotatable seat achieves said rotated position, said curtain forming a changing room when said rotatable seat achieves said rotated position and said curtain frame is extended from said rotatable seat.

20. The boat of claim 19, further comprising:

a seat cushion positioned atop said seat support; and a seat back cushion positioned atop a first side of said seat back.

21. The boat of claim 19, wherein said curtain frame is substantially U-shaped, said curtain frame having a pair of opposing sides and an end substantially perpendicular to and spanning said sides, said ends substantially parallel to and spaced from said seat when said curtain frame is extended from said seat.

22. The boat of claim 19, wherein said seat back abuts said lounge cushion when said rotatable seat maintains said seating position.

23. The boat of claim 19, wherein said seat back includes a top and a bottom, said top being spaced further from said deck than said bottom when said rotatable seat maintains said seating position, said lounge cushion abutting said top of said seat back when said rotatable seat maintains said seating position.

24. The boat of claim 19, further comprising:

first biasing member means connected to said rotatable seat for selectively maintaining said rotatable seat in said rotated position.

25. The boat of claim 19, further comprising:

second biasing member means connected to said curtain frame for selectively maintaining said curtain frame in said extended position.

26. The boat of claim 24, wherein said first biasing member means comprises a gas shock.

27. The boat of claim 25, wherein said first biasing member means comprises a gas shock.

28. A boat, comprising:

a deck;

a fence positioned substantially about the perimeter of the deck;

a stem gate formed in said fence;

a rotatable seat positioned adjacent said stem gate, comprising:

a seat support;

a seat back connected to said seat support;

said rotatable seat rotatable between a seating position and a rotated position without blocking passage through said stem gate in either said seating position or said rotated position;

a curtain frame connected to said rotatable seat; and a curtain depending from said curtain frame;

said curtain frame and said curtain stowable under said seat when said rotatable seat maintains said seating position, said curtain frame extendable from said seat support to an extended position when said rotatable seat achieves said rotated position, said curtain forming a changing room when said rotatable seat achieves said rotated position and said curtain frame is extended from said rotatable seat, whereby said changing room does not block passage through said stem gate.

29. The boat of claim 28, further comprising:

a seat cushion positioned atop said seat support; and a seat back cushion positioned atop a first side of said seat back.

30. The boat of claim 28, wherein said curtain frame is substantially U-shaped, said curtain frame having a pair of opposing sides and an end substantially perpendicular to and spanning said sides, said ends substantially parallel to and spaced from said seat when said curtain frame is extended from said seat.

31. The boat of claim 28, further comprising:

first biasing member means connected to said rotatable seat for selectively maintaining said rotatable seat in said rotated position.

32. The boat of claim 28, further comprising:

second biasing member means connected to said curtain frame for selectively maintaining said curtain frame in said extended position.

33. The boat of claim 31, wherein said first biasing member means comprises a gas shock.

34. The boat of claim 32, wherein said second biasing member means comprises a gas shock.

35. A boat, comprising:

a deck;

a rotatable seat rotatably connected to the boat, comprising:

a seat support;

a seat back connected to said seat support;

a lounge cushion positioned atop said deck adjacent said seat back and extending in a rearward direction away from said seat back; and a bracket connected to said seat and extending rearwardly therefrom, said bracket pivotally connected to the boat rearwardly of said seat back, said bracket spaced a distance from said lounge cushion.

36. The boat of claim 35, further comprising:

a seat cushion positioned atop said seat support; and a seat back cushion positioned atop a first side of said seat back.

37. A boat, comprising:

a deck;

a lounge cushion positioned atop said deck;

a rotatable seat rotatably connected to the boat and rotatable from a seating position to a rotated position, comprising:

a seat support;

a seat back connected to said seat support;

a bracket connected to said seat and extending rearwardly therefrom, said bracket pivotally connected to the boat rearwardly of said seat back, said bracket extending underneath said lounge cushion, and pivotable relative to said lounge cushion.

38. The boat of claim 37, further comprising:

a seat cushion positioned atop said seat support; and a seat back cushion positioned atop a first side of said seat back.

39. A collapsible changing room, comprising:

a rotatable seat, comprising:

a seat support;

a seat back connected to said seat support;

a bracket having a first leg and a second leg, said first leg fixed to said rotatable seat, said first leg extending rearwardly away from said seat back, said second leg extending from said first leg and forming an angle with said first leg at an intersection of said first and said second legs, said second leg spaced from said seat back, said second leg having a hinge end opposite the intersection of said first and said second legs;

a curtain frame connected to said rotatable seat, said curtain frame movable from a stored position adjacent said seat support to an extended position extending from said seat support; and a flexible curtain depending from said curtain frame;

said rotatable seat rotatable about said hinge end of said second leg of said bracket from a seating position to a rotated position, said curtain frame and said curtain stowable under said seat support in said stored position when said rotatable seat maintains said seating position, curtain frame movable to said extended position when said rotatable seat achieves said rotated position, said curtain forming a changing room when said rotatable seat achieves said rotated position and said curtain frame achieves extended position.

40. The collapsible changing room of claim 39, further comprising:

a seat cushion positioned atop said seat support; and a seat back cushion positioned atop a first side of said seat back.

41. The collapsible changing room of claim 39, further comprising:

a first biasing member means connected to said bracket for selectively maintaining said rotatable seat in said rotated position; and a second biasing member means connected to said curtain frame for selectively maintaining said curtain frame in said extended position.

42. The collapsible changing room of claim 41, wherein said first and second biasing member means comprise gas shocks.

43. The collapsible changing room of claim 39, wherein said curtain frame is substantially U-shaped, said curtain frame having a pair of opposing sides and an end substantially perpendicular to and spanning said sides, said end substantially parallel to and spaced from said seat when said curtain frame achieves said extended position.

44. A boat, comprising:

a deck;

a rotatable seat, comprising:

a seat support;

a seat back connected to said seat support;

a lounge cushion positioned atop said deck adjacent said seat back and extending in a rearward direction away from said seat back;

bracket means connecting said rotatable seat to the boat and for allowing said rotatable seat to pivot between a seating position and a rotated position without movement of said lounge cushion;

curtain frame means for supporting a flexible curtain, said curtain frame means connected to said rotatable seat; and a flexible curtain depending from said curtain frame means;

said curtain stowable under said seat when said rotatable seat maintains said seating position, said curtain frame means extendable from said seat support when said rotatable seat achieves said rotated position, said curtain frame forming a changing room when said rotatable seat achieves said rotated position and said curtain frame means is extended from said rotatable seat.

45. The boat of claim 44, wherein said bracket means comprises a bracket extending away from said seat back.

46. The boat of claim 44, wherein said curtain frame means comprises a curtain frame rotatably connected to said rotatable seat, said curtain frame rotatable from a stored position adjacent said seat support to an extended position extending from said seat support.

47. The boat of claim 44, further comprising:

a seat cushion positioned atop said seat support; and a seat back cushion positioned atop a first side of said seat back.

48. The boat of claim 46, further comprising:

a first biasing member means connected to said bracket means for selectively maintaining said rotatable seat in said rotated position; and a second biasing member means connected to said curtain frame for selectively maintaining said curtain frame in said extended position.

49. The boat of claim 48, wherein said first and said second biasing members comprise gas shocks.

50. A boat, comprising:

a rotatable seat rotatable from a seating position to a rotated position, comprising:

a seat support;

a seat back connected to said seat support, said seat back adjacent a lounge cushion;

a bracket fixably secured to said rotatable seat, and extending away from said seat back, said bracket positioned intermediate said deck and said lounge cushion when said rotatable seat is in said seating position, said bracket having a component substantially perpendicular to said deck and spaced rearwardly from said seat back when said rotatable seat is in said seating position;

a curtain frame connected to said rotatable seat, said curtain frame movable from a stored position adjacent said seat to an extended position extending from said seat support; and a flexible curtain depending from said curtain frame;

said curtain frame and said curtain stowable under said seat in said stored position when said rotatable seat maintains said seating position, said curtain frame movable to said extended position when said rotatable seat achieves said rotated position, said curtain forming a changing room when said rotatable seat achieves said rotated position and said curtain frame achieves said extended position.

51. The boat of claim 50, wherein said bracket comprises a bracket having a first leg and a second leg, and wherein said first leg comprises said bracket component substantially perpendicular to said deck and spaced from said lounge cushion when said rotatable seat is in said seating position, said first leg of said bracket having a first end affixed to said rotatable seat adjacent an intersection of said seat back and said seat, said second leg extending from said first leg substantially parallel to said seat back when said rotatable seat is in said seating position, said second leg spaced from said seat back.

52. The boat of claim 50, further comprising:

a seat cushion positioned atop said seat support; and a seat back cushion positioned atop a first side of said seat back.

53. The boat of claim 50, further comprising:

a first biasing member means connected to said bracket for selectively maintaining said rotatable seat in said rotated position; and a second biasing member means connected to said curtain frame for selectively maintaining said curtain frame in said extended position.

* * * * *

UNITED STATES PATENT AND TRADEMARK OFFICE

CERTIFICATE OF CORRECTION

PATENT NO. : 6,715,440 B2 
DATED : April 6, 2004
INVENTOR(S) : Baron R. Biedenweg and David L. Putman It is certified that error appears in the above-identified patent and that said Letters Patent is hereby corrected as shown below:

Title page,
Item [57], ABSTRACT,
Line 4, delete "stem" and insert -- stern --.

Column 8,
Lines 14, 15, 21 and 33, delete "stem" and insert -- stern --.

Signed and Sealed this

Twenty-ninth Day of June, 2004

JON W. DUDAS
*Acting Director of the United States Patent and Trademark Office*